United States Patent [19]

Maus

[11] 4,434,678

[45] Mar. 6, 1984

[54] CONTROL MECHANISM FOR A WINDOW OR DOOR

[75] Inventor: Julius Maus, Stuttgart, Fed. Rep. of Germany

[73] Assignee: Gretsch-Unitas GmbH, Fed. Rep. of Germany

[21] Appl. No.: 285,933

[22] Filed: Jul. 23, 1981

[30] Foreign Application Priority Data

Jul. 23, 1980 [DE] Fed. Rep. of Germany ..... 3027810

[51] Int. Cl.[3] ..... G05G 9/00

[52] U.S. Cl. ..... 74/471 R; 74/104

[58] Field of Search ..... 74/471 R, 104; 49/193, 49/192

[56] References Cited

U.S. PATENT DOCUMENTS 3,057,221 10/1962 Smith ..... 74/471 X 3,083,587 4/1963 Buddo ..... 74/471

*Primary Examiner*—Philip C. Kannan

*Attorney, Agent, or Firm*—McGlew and Tuttle

[57] ABSTRACT

A control device is disclosed for selectively displacing two drive rod drivers which are coupled to drive rods of a window or door. The device includes a housing having a guide path defined therein for slidably receiving two drivers. The handle includes a turning member which is directly engaged with one driver and the device includes a clutch which is selectively engageable or disengageable between the two drivers so that, with rotation of the handle member, either both or one of the drivers may be moved along the guide path in the housing.

18 Claims, 5 Drawing Figures

CONTROL MECHANISM FOR A WINDOW OR DOOR

FIELD AND BACKGROUND OF THE INVENTION

The present invention relates in general to window and door controls and, in particular to a new and useful control device which utilizes a single pivotable handle for selectively moving one or two driver elements for driving rods connected thereto, which rods are used in opening, closing or adjusting the position of windows or doors.

Such control mechanisms have been employed in the manufacture of windows for a long time, and are known as "bascule" mechanisms or "bascule" bolts. They serve the purpose of simultaneously shifting both drive rods, in order to lock the casement of sash to the fixed window frame, or to disengage it therefrom.

The invention is directed to an improvement of a mechanism of this kind which permits displacement of only one of the drive rods, if needed.

SUMMARY OF THE INVENTION

The invention provides that one of the drive rods is connected to a turning member through an interposed clutch. With the clutch engaged, turning of the handle causes shifting of both of the drive rods, while upon disengagement, only one of the drive rods can be shifted by means of the handle. This control mechanism may therefore find application wherever it is desired to bring a window or door element selectively into functional positions. The invention is applicable to swinging, or combined sliding and swinging sashes or casements. Through the two drive rods, certain elements of the fitting of such a window or door can be actuated, and by pivoting the handle, either all of the respective elements of the fitting or only some of them may be moved, depending on the position of the clutch.

A particularly advantageous feature of the invention provides that the clutch includes two coupling members which are mounted for displacement in a housing, which coupling members are each connected to a separate drive rod of a window or door to be controlled. The first of these coupling members is operatively connected to the turning member and a coupling element is engageable between the two coupling members to either mechanically couple them together or permit separate movement thereof. The coupling members are intended to be coupled each to one of the drive rods, and after the assemblage of the control mechanism, they are preferably permanently connected thereto. Each coupling member comprises a coupling element making it possible to establish or interrupt a driving connection with the respective drive rod. Since the two coupling members can be coupled to, or disengaged from each other by means of the coupling element, it will easily be understood that upon actuating the handle and as long as the clutch is engaged, the drive rods of this control mechanism cannot move in opposite directions, as in a bascule mechanism, but only in the same direction, for example both upwardly or both downwardly.

In a control mechanism in which only one of the coupling elements is movable out of engagement, a development of the invention provides that the coupling element which is movable out of engagement is designed as a one armed lever which is mounted on the second coupling member and biasing means in the form of a return spring urging the coupling element out of engagement with the first coupling member. Upon actuating this movable coupling element, for example, by means of a suitable manner to swing it into its effective position, against the action of a return spring, the respective drive rod becomes engaged, provided that at the same time, the nonmovable, opposite coupling element is in proper position for engagement. Suitable measures must be taken in addition to allow a disengagement of the clutch under the action of the return spring only if desired. This may easily be obtained by a corresponding design of the member for actuating the movable coupling element.

In a further development of the invention, it is provided that the coupling element which is movable out of engagement with the first coupling member carries at least one locking element which, in an engagement position, engages a coupling element of the first coupling member which is designed as a locking recess for receiving the movable coupling element. The locking member and locking recess must be designed to make the locking engagement and disengagement possible, through a simple pivotal motion. On the other hand, however, the engagement must not unlock during a simultaneous displacement of the drive rods.

In this regard, another development of the invention provides that the coupling members are mounted for displacement in one and the same guideway of the housing and, with the clutch engaged, they abut each other. Even though, with the clutch engaged, an abutment of the coupling members on each other is not necessary, in principle, to effect the coupling, neither in one nor in the opposite direction, the inventive arrangement represents a very compact and space saving construction. With the clutch engaged, the two coupling members apply against each other in any position of displacement. With the clutch disengaged, they abut only in one end position of displacement. This design has the advantage that when an operation is done by mistake, the drive rod which has been disengaged, can still be shifted back.

As explained in the foregoing, the movable coupling element is swung or pivoted into its engaged position against the action of the return spring. It is relatively simple to hold this coupling element in an engaged position by means of the control member, as long as the drive rods remain in place. However, upon starting the displacement of the drive rods by means of the handle, the movable coupling element is shifted away from the control member. To prevent a disengagement during the further displacement, a preferred embodiment of the invention provides that the coupling element which is movable out of engagement is displaceable past a hold-down element or rib which is provided on the housing. This is particularly in the form of a projection or the like extending from inside the housing. Soon after the start of displacement, the movable coupling element comes from below into contact with a housing projection, designed as a rib, for example, and may thus be held down during the entire further displacement. Only if shifted back into its starting position, the movable coupling element ceases to be held down by this rib and may be swung back into its disengaged position by the return spring.

According to another embodiment of the invention, the movable coupling element can be swung or pivoted, at least in the direction of engagement, by means of a control member, particularly a rotatable one. In the direction of disengagement, the coupling element is moved by the return spring, so that no assistance of the control member is needed. Nevertheless, the back motion of the coupling element may also be effected, or at least supported, by the control member or by another mechanism.

With a rotatable control member, the invention further provides that the control member comprises a pressure element located eccentrically of the axis of rotation of the control member which engages a swingable and/or resiliently bendable transfer member provided between the pressure element and the movable coupling element. This makes it possible, in a simple way, to transform the rotary motion of the control member into a swingable motion by which the movable coupling element is brought into engagement. This swinging motion of the transfer member is caused by the pressure element of the control member which, while following the rotary motion of the latter, moves more or less away from the swinging or bending axis of the transfer member, thereby causing a corresponding displacement of the free end of the transfer member. To save space and a separate return spring for the transfer member, it may be provided that the transfer member is designed as a leaf spring whose free end applies or can be applied against, can swing substantially parallel with the movable coupling element and with the coupling element disengaged from the first coupling member, the transfer member being at least to a large extent free of tension and not effective to move the movable coupling element. To obtain a maximum displacement of the free end of the transfer member and the pivoting of the movable coupling element with a relatively small rotary motion of the control member, such as not exceeding 90°, a further development of the invention provides that the pressure element engages a locking recess or hole of the transfer member. Advantageously, a locking recess or hole and the pressure element have identical cross-sectional shapes. More particularly, it is provided that the locking recess is designed as a circular through hole and the pressure element as a cone or truncated cone. Due to its oblique surface, the cone or truncated cone easily disengages from or engages into the recess, the truncated cone being preferred in view of its further displacement on the transfer member. This design is quite satisfactory to obtain the desired motion of the transfer member, and the varying distance of the pressure element from the swing or bending axis of the transfer member in the two end portions of turning becomes irrelevant, or at least an unimportant factor, so that no bounds are set on the design in this regard. In particular, the pressure element may be designed to follow an only small radius, to obtain a very compact construction.

Still another form or feature of the invention provides that the first coupling member is provided on its end facing the second coupling member with at least one wedge shaped control element corresponding with the associated locking element to form a return mechanism for the movable coupling element. This return mechanism becomes effective in instances where either the return spring is broken, or the movable coupling element has been moved into its position of engagement without having the other coupling element in the proper position for engagement, i.e., in the initial position of the control mechanism. If, in such an instance, the coupling member which is operatively connected to the turning member is moved back, the movable coupling element is moved by thhe control element or elements into its position of disengagement at least until the two coupling elements come again into a position for mutual engagement. Consequently, provided that the position of the control member is not changed, the two coupling members become engaged with each other automatically at the end of the back motion. Advantageously, the rear end of each of the control elements may be used to form the locking recess. The control mechanism is then particularly reliable in operation.

In another feature of the invention it is provided that the return spring or biasing means of the movable coupling element is designed as a leaf spring having one end secured, particularly by coupling, to the coupling element and at its other end which is bent out of the plane of the coupling element, bears against the housing, and preferably a removable cover of the housing. This again leads to a compact construction which is little susceptible to troubles and inexpensive in manufacture.

For the same reason, it is advantageous to provide that the first coupling member is provided with a control groove which extends transversely to the direction of displacement of the coupling member, and that the turning member carries an eccentric control pin, particularly one mounted on the turning member for rotation, operatively engaging the control groove. Accordingly to another feature of the invention, the two coupling members are of identical design and positioned in mirror image fashion within the housing. This last mentioned feature particularly contributes to low manufacturing costs and to a simplified storage.

Finally, another feature of the invention provides that each coupling member carries a mandrel shaped driver extending perpendicularly to the direction of displacement of the members and engaging a driver recess provided on an associated drive rod of the window or door. The drive rods can thus be connected to the mechanism in a particularly simple manner, by simply fitting them onto the respective driver.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the accompanying drawings in which.

DESCRIPTION OF THE PREFERRED EMBODIMENT

Figures 1, 2, 3, 4, 5:
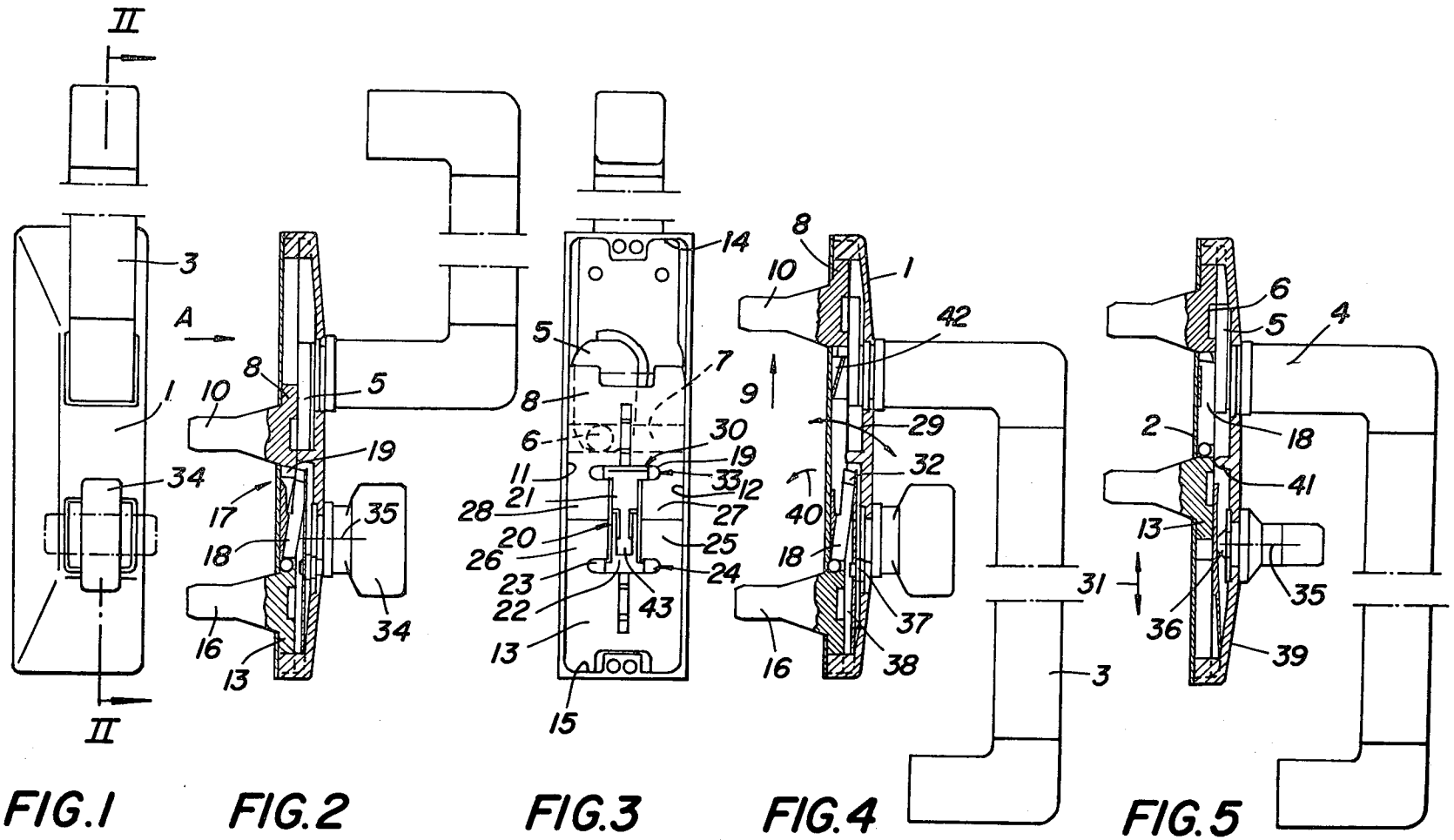
FIG. 1 is a top plan view of a control mechanism according to the invention.
FIG. 2 is a sectional view taken along the line II—II of FIG. 1.
FIG. 3 is a view of the mechanism in the direction of arrow A of FIG. 2.
FIG. 4 is a view corresponding to FIG. 2 and showing a first switching position.
FIG. 5 is a similar view to FIG. 4, showing a second switching position.

Turning to the drawings in particular, the invention embodied therein as shown in the figure comprises a control mechanism for selectively moving one or two control rods which are connected to windows or doors. The mechanism according to the invention comprises a housing having a control handle 3 rotatably mounted thereto which, with an additional control knob or member 34, is movable to move either one or both of the elements to which the window or door rods are to be connected.

The handle 3 is mounted for rotation in a shell-type housing 1 having a removable cover 2 (the cover being omitted in FIG. 3.) This arrangement is of a kind commonly used with hung and slide or horizontally and vertically pivoting doors, windows and the like. The mounted end 4, of the handle 3, carries, inside the housing, a turning member 5 which is non-rotatably secured thereto. Turning member 5 comprises a one-armed lever and a control pin 6 which is provided on the free end of the lever and is preferably freely rotatable about its longitudinal axis and is designed as a kind of a sliding block. Control pin 6 is engaged into a control groove 7 of a first coupling member 8. Upon turning handle 1, starting from the position shown in FIG. 2, through 180° into the position shown in FIG. 4, the cooperation of control pin 6 and control groove 7 causes a displacement of first coupling member 8 in the direction of arrow 9. Handle 3 is rotated in a counter-clockwise direction as viewed from FIG. 3. In assembled state, a mandrel-shaped driver 10 of first coupling member 8 is coupled to a drive rod (not shown), so that this drive rod is displaced in the direction of arrow 9 upon turning handle 3 through 180°. The turning of the handle is limited, for example, by providing that the inside surface 11 of housing 1 serve as a stop for selectively stopping one of the longitudinal sides of turning member 5.

Inside surface 11 and the parallel inside surface 12 of the housing, form at the same time a guideway for first coupling member 8 and a second coupling member 13. Both coupling members are of identical design and so dimensioned that in one end position of displacement, they apply against transverse edge 14 and in the other end position against transverse edge 15 of housing 1. In either of the end positions, they may directly apply against each other, as shown in FIGS. 3 and 5. This, however, is not the case as a rule. First coupling member 8 may also be displaced independently as shown in FIG. 4, without second coupling member 13, in the direction of arrow 9. In the showing of FIG. 4, the two coupling members are spaced from each other at a maximum distance, while in the showing of FIGS. 2 and 5, the spacing therebetween is minimized, preferably reduced to zero. Driver 16 on second coupling member 13, is coupled to a second drive rod (not shown). Whether or not second coupling member 13 follows the movement of first coupling member 8, in the direction of arrow 9, only depends on whether a clutch 17, provided between the two members, is engaged or disengaged. As stated above, with the clutch engaged, the two drive rods are displaced in the direction of arrow 9 simultaneously and at the same speed at any instance, if handle is turned from one to the other position.

Second coupling member 13 carries a movable coupling element 18 which cooperates with a coupling element 19 of first coupling member 8. Since movable coupling element 18 is loaded by a bow-shaped return spring 20 having its free end bent away from the plane of element 18 and bearing against the inside surface of cover 2, the position of element 18 is ordinarily obliquely inclined as shown in FIG. 2. Coupling element 18 comprises a pivot pin portion 22 which is received, by its two ends, into bearing seats 23, 24 which are provided in second coupling member 13. In the space between two legs 25, 26 and 27, 28 of coupling members 13 and 8, respectively, coupling element 18 is pivotable in the direction of double arrow 29. As evident from FIG. 3, the two coupling members 8, 13 are inserted in the guideway of housing 1 in mirror-inverted positions.

On its remote from pivot portion 22, movable coupling element 18 is T-shaped. In the position shown in FIG. 5, the free ends of the T-legs engage a transverse slot 30 of first coupling member 8, which slot forms the fixed coupling element 19 which, aside from the displacement in the direction of arrow 31, is not movable. The free ens of the T-legs thus form locking elements 32, and the two ends of transverse slot 30 form locking recesses 33.

Since return spring 20 holds movable coupling element 18 in a plane which is inclined relative to the plane of displacement, locking elements 32 in their initial position, do not engage locking recesses 33. The engagement of clutch 17 is effected by means of a rotatable control member 34, preferably a knob which can be turned through 90°. Member 34 carries a pressure element 36 which is provided eccentrically of the axis of rotation 35 of the control member 34 (FIG. 5), and cooperates with a locking recess 37 of a transfer member 38. Transfer member 38 is preferably a leaf spring having its end 39 extending close to transverse edge 15 secured, for example, riveted, to the housing. Locking recess 37 is preferably a circular hole and pressure element 36 has the shape of a truncated cone. Upon turning control member 34 through 90°, starting from the position shown in FIG. 4, into the position shown in FIG. 5, pressure element 36 disengages from locking recess 37 and applies against the adjacent flat surface of transfer member 38. Transfer member 38 is thereby elastically bent and its free end pushes the free end of movable coupling element 18 downwardly, in the direction of arrow 40, against the action of return spring 20. Clutch 17 is thereby engaged. If now, handle 3 is brought from its position shown in FIG. 2, into the position shown in FIG. 5, second coupling member 13 does not remain in its position shown in FIG. 4, but is taken along in the direction of arrow 9, and the two drive rods follow this movement. Since during this displacement, movable coupling element 18 is gradually shifted away from the free end of transfer member 38, a suitable measure must be taken to prevent return spring 20 from causing a disengagement of the clutch. For this purpose, the housing is provided with a projection in the form of a rib acting as a hold-down 41 for the engaged coupling element 18. Already after a short distance covered by the displaceable parts in the direction of arrow 9, coupling element 18 passes beneath hold-down 41 and remains held down either up to reaching the end position of displacement, or at least until another part of the mechanism becomes effective as a new hold-down. In the shown embodiment, this latter possibility is provided and, for example, FIG. 5 shows that in its "upper" position of displacement, movable coupling element 18 is prevented from pivoting back, against the direction of arrow 40, by turning member 5, so that the clutch cannot disengage.

Since they are identical in design, either of coupling members 8, 13 carries two spaced apart, wedge-like control elements 42 which may cooperate with the pin-shaped locking elements 32 of movable coupling element 18, as will be explained hereinafter, wherefore their spacing corresponds to that of locking elements 32. It should be noted in addition that the other end of bow-shaped return spring 20 is clamped in a groove-like recess of movable coupling element 18.

The control mechanism as described in the foregoing is not only simple in design, but also very rugged and reliable in operation, insofar as wrong operation cannot occur or is ineffective in any position of handle 3 or rotary control member 34. Starting from the initial positions of handle 3 and control member 34 shown in FIG. 2*a*, turning of handle 3 through 180° or through another, particularly smaller angle, causes a displacement of driver 10 from its position shown in FIG. 2 into its position shown in FIG. 4. Since clutch 17 is not engaged, driver 16 cannot follow this displacement, and only the drive rod coupled to driver 10 is displaced, while the drive rod coupled to driver 16 remains in its position. However, if prior to turning handle 3 as mentioned, control member 34 is turned through a selected angle, preferably 90°, clutch 13 is engaged and both drive rods are displaced conjointly in one or the other direction.

If, starting from the position shown in FIG. 5, control member 34 is returned into its initial position shown in FIG. 2, and then handle 3 is brought back into its position also in FIG. 2, nothing is changed in the initial coupling of the drive rods, neither the elastic return of transfer member 39 nor the action of return spring 20 can become effective as long as hold-down 41 does not release the movable coupling element 18. This, however, happens only after the initial position has been reached again (FIG. 2 or 4).

It is further possible to start from the position shown in FIG. 4 and turn control member 34 into its position according to FIG. 5. If then handle 3 is turned back into its initial position shown in FIG. 2, the two control elements 42 push second coupling member 13 from its position shown in FIG. 5 into the position shown in FIG. 2, against the resilient resistance of transfer member 38. As soon as locking elements 32 come at a level with locking recess 19, the spring force of transfer member 38 can produce its effect, since now the control elements have already completely passed locking elements 32. It will be understood in connection with the foregoing, that control member 34 may even be turned, in any position of handle 3, without affecting the actuation of the drive rods or of any part of the control mechanism.

While a specific embodiment of the invention has been shown and described in detail to illustrate the application of the principles of the invention, it will be understood that the invention may be embodied otherwise without departing from such principles.

For additional details of the window design and mounting useable with this invention, please see the copending application entitled "window and door mounting" by this inventor, which is incorporated here by reference.

What is claimed is:

1. A control device for selectively displacing two drive rod drivers comprising:

a housing having means defining a guide path therein;

a handle member rotatably mounted to said housing;

two drivers movable in said housing along said guide path;

means engaging said handle member with one of said drivers for movement of said one driver with rotation of said handle member;

a clutch in said housing for engaging the other of said drivers with said handle member for movement of said other driver with rotation of said handle member; and said clutch including a coupling element connected to one of said drivers movable into a first position engaged with the other of said drivers and into a second position out of engagement with the other of said drivers.

2. A device according to claim 1, wherein said means engaging said handle member with one of said drivers comprises said one driver including a control groove extending substantially transversely to a direction of movement of said one driver in said housing, a turning member connected to said handle member with an eccentrically located pin thereon engaged with said control groove whereby rotation of said handle member causes motion of said one driver along said guide path.

3. A device according to claim 1 including means biasing said coupling element into its second position comprising a bent leaf spring having one leg secured to said coupling element and another leg extending at an angle to a plane containing said coupling element engaging against a portion of said housing.

4. A device according to claim 3, including a covering for said housing for covering said guide path, said clutch and said drivers, said leaf spring for biasing said coupling element bearing against said cover.

5. A device according to claim 1, wherein said coupling element comprises a one arm lever pivotally mounted to said other driver and biasing means in said housing for biasing said coupling element into its second position.

6. A device according to claim 5, including a hold-down member connected in said housing for maintaining said coupling element in its first position with movement of said drivers by rotation of said handle member.

7. A device according to claim 5, including coupling means on said one driver for receiving and coupling with said coupling element in its first position, said coupling element including at least one locking part engageable with said coupling means in said first position of said coupling element.

8. A device according to claim 7, wherein said coupling means of said one driver comprises a recess for receiving said coupling part of said coupling element.

9. A device according to claim 5, wherein said drivers are mounted for sliding engagement on said guide path in said housing, said drivers abuting each other with said coupling element in its first position coupling said drivers together.

10. A device according to claim 9, wherein said guide path comprises a single guideway defined in said housing, said two drivers slidably mounted in said single guideway.

11. A device according to claim 5, including control member means movably mounted to said housing and engageable with said coupling element for moving said coupling element from its second position into its first position.

12. A device according to claim 11, wherein said control member means comprises a control member rotatably mounted to said housing, a pressure element connected to said control member and positioned eccentrically of an axis of rotation of said control member, and a swingable transfer member engaging said pressure element and engageable with said coupling element for movement of said coupling element with rotation of said control member.

13. A device according to claim 12, wherein said transfer member comprises a leaf-spring having a free end engaged with and moving substantially parallel with said coupling element.

14. A device according to claim 13, including at least one wedge shaped control portion connected to said one driver engageable with said locking part of said coupling element for returning said coupling element into it second position with movement of said one driver toward said other driver.

15. A device according to claim 13, wherein said transfer member has a recess therein for receiving said pressure element, said control member being rotatable to disengage said pressure element from said transfer member recess to move said transfer member against said coupling element to move said coupling element toward its first position.

16. A device according to claim 15, wherein said transfer member recess is a substantially circular through hole in said transfer member and said pressure element comprises a conical projection.

17. A control device for selectively displacing two drive rod drivers comprising:

a housing having means defining a guide path therein;

a handle member rotatably mounted to said housing;

two drivers movable in said housing along said guide path;

means engaging said handle member with one of said drivers for movement of said one driver with rotation of said handle member;

a clutch in said housing for engaging the other of said drivers with said handle member for movement of said other driver with rotation of said handle member;

said drivers each comprising a coupling member slidably mounted in said guide path and a mandrel portion extending from said coupling member and out of said housing, each of said drivers being substantially identical in design to each other and positioned in mirror image fashion in said housing and on said guide path.

18. A device according to claim 17, wherein each of said mandrels extends substantially perpendicular to a direction of displacement of said drivers on said guide path.

* * * * *